United States Patent [19]

Czwienczek et al.

[11] Patent Number: 4,803,968

[45] Date of Patent: Feb. 14, 1989

[54] APPARATUS FOR DELIVERING FUEL TO INTERNAL COMBUSTION ENGINES

[75] Inventors: Peter W. Czwienczek, Padbury; Christopher N. F. Sayer, Ferndale; Darren A. Smith, Scarborough; Michael L. McKay, Willetton; Robin M. Briggs, Marmion, all of Australia

[73] Assignee: Orbital Engine Company Proprietary Limited, Balcatta, Australia

[21] Appl. No.: 169,468

[22] Filed: Mar. 10, 1988

Related U.S. Application Data

[62] Division of Ser. No. 866,425, May 23, 1986, Pat. No. 4,754,739.

[30] Foreign Application Priority Data

May 24, 1985 [AU] Australia ..... PH0731

[51] Int. Cl.[4] ..... F02M 67/02; F02M 69/08

[52] U.S. Cl. ..... 123/533; 123/531

[58] Field of Search ..... 123/531–535

[56] References Cited

U.S. PATENT DOCUMENTS

| | | | |
|---|---|---|---|
| 3,893,436 | 7/1975 | Beekhuis, Jr. | 123/531 X |
| 4,462,760 | 7/1984 | Sarich et al. | 123/531 X |
| 4,519,356 | 5/1985 | Sarich | 123/531 X |
| 4,554,945 | 11/1985 | McKay | 123/531 X |

*Primary Examiner*—Tony M. Argenbright

*Attorney, Agent, or Firm*—Armstrong, Nikaido Marmelstein & Kubovcik

[57] ABSTRACT

A fuel metering apparatus having a metering chamber to hold fuel for subsequent delivery to an engine and a rigid metering member projecting into said chamber and linearly movable relative to the chamber to vary the extent of projection of the metering member into the chamber to thereby control the quantity of fuel displaceable from the chamber for delivery to an engine. An inextensible flexible member between secured to the metering member and to a motor that operate in accordance with the engine fuel demand, the motion of the motor being transmitted to the metering member through the inextensible flexible member. This inextensible flexible member preferably being adjustably coupled to the motor so the limit of movement of the metering member may be set as required.

13 Claims, 6 Drawing Sheets

APPARATUS FOR DELIVERING FUEL TO INTERNAL COMBUSTION ENGINES

This is a divisional application of Ser. No. 866,425, filed May 23, 1986, now U.S. Pat. No. 4,754,739.

This invention relates to an improvement in apparatus for metering fuel to an internal combustion engine, wherein the quantity of fuel delivered may be varied in accordance with engine load by controlling the quantity of fuel displaceable from a metering chamber by a pulse of gas.

It has previously been proposed in our U.S. Pat. No. 4,554,945 to vary the quantity of fuel displaceable from a metering chamber by providing a metering rod which extends into the chamber and is connected to an external actuator, whereby the degree that the metering rod projects into the metering chamber may be varied in accordance with fuel requirements. It will be appreciated that the movement of the metering rod must be accurately controlled, as under normal operating conditions the need for accurate metering of the fuel requires relatively small degrees of movement, with such movements being effected in the matter of a few milliseconds. Also under engine transient conditions e.g. rapid acceleration, it is required to move the metering rod a substantial extent in a very short time interval, in order to have acceptable engine response to varying load conditions. These operating parameters can be significantly affected by inertia and friction forces acting on the metering rod as it undergoes changes in position in accordance with variations in fuel demand.

In view of these requirements it has previously been proposed to support the metering rod, for movement relative to the metering chamber, by comparatively free bearing supports in order to reduce friction forces acting on the metering rod. This form of free support has also assisted in manufacture of the metering unit by widening the tolerances acceptable for alignment of the metering rod with the bearings and/or the mechanism which actuates the metering rod in response to engine fuel demands. Also in these proposed constructions close fitting seals have not been provided to co-operate with the metering rod, and so fuel and/or air leakage occurred between the metering chamber and the metering rod. Accordingly provision was required to be made to accommodate this leakage, and prevent the leakage being released to atmosphere. This led to the necessity to trap the leakage and retain it within the fuel system of the vehicle, and hence presented a fuel vapour load which had to be reintroduced into the basic fuel supply system at some point.

The above discussed factors relating to the operation of a fuel metering system, and the difficulties in currently proposed systems, presented the need to provide an improved metering apparatus wherein the above discussed problems are substantially eliminated or at least significantly reduced.

It is therefore proposed by the present invention to provide in a fuel metering apparatus having a metering chamber to hold fuel for subsequent delivery to an engine and a rigid member projecting into said chamber and linearly movable relative to the chamber to vary the extent of projection of the rigid member into the chamber to control the quantity of fuel displaceable from the chamber for delivery to an engine, and an inextensible flexible member secured to the rigid member and coupled to actuator means operable to transmit motion to the rigid member in response to changes in engine fuel demand.

Conveniently the inextensible flexible member is adjustably coupled to the actuator means so the limits of movement of the rigid member may be set as required. The adjustable coupling of the flexible member of the actuator means may be used to calibrate the metering unit, such as by setting the position of the rigid member in the chamber to determine the minimum quantity of fuel displaceable. This setting of the positions of the rigid member is particularly important when a number of metering units are operated by the one actuator means such as for a multi-cylinder engine.

Clamp means may be provided to couple the inextensible flexible member to the actuator means. The clamp means are preferably constructed so that, during calibration of the metering apparatus the rigid member is located approximately at the datum position in the metering chamber, and the flexible member is clamped at a relatively low force. This allows movement of the flexible member relative to the actuator means to effect the necessary adjustment of the rigid member position without totally releasing the clamping force. The clamping force is increased after the adjustment has been completed.

Alternatively the inextensible flexible member may be coupled to the actuator means in a non-adjustable manner such as by bonding, welding or mechanically locking.

The rigid member may have a passage therein through which a gas can flow to enter the chamber and effect displacement of fuel from the chamber. A selectively operable valve may be provided in the passage to control the timing and period of the admission of gas to the chamber, and hence the delivery of fuel, relative to the engine cycle. The valve may be of the passive or check valve type which will open in response to the pressure in the passage rising above a predetermined value.

The inextensible flexible member may be in the form of a high tensile mono-filament strand or wire, preferably stainless steel wire. The flexible character of the wire simplifies manufacturing cost as a reasonable degree of misalignment between the direction of motion of the rigid member and the point of coupling of the wire to the actuator means can be accommodated.

The inextensible flexible member must have sufficient stiffness to transmit a compressive force between the actuator means and the rigid member, to push the rigid member further into the metering chamber. However it must also be sufficiently flexible to accommodate by flexing any misalignment between the respective ends of the wire where they are attached to compatively rigid components. The magnitude of the compressive force may be reduced by maintaining the fluid pressure induced forces (fluid forces) acting on the rigid member in a balanced or near balanced state during operation of the metering apparatus.

A support assembly may be provided, intermediate the rigid member and the actuator member, that will accommodate misalignment without significant increase in the frictional resistance to longitudinal movement of the inextensible flexible member. The support assembly may be constructed to provide a close longitudinal sliding fit on the inextensible flexible member, and to have limited movement in the direction transverse to the direction of sliding movement of the inextensible flexible member.

Conveniently the rigid member preferably has the passage therein and selectively operable valve as previously referred to, with the valve located adjacent to the end of the rigid member within the metering chamber, and the other end communicating with a gas chamber.

The inextensible flexible member is preferably attached to the rigid member in the gas chamber and extends through the wall thereof to be connected externally to the actuator means. The intermediate support assembly previously referred to may be provided in the wall of the gas chamber, and be constructed to provide a gas seal about the inextensible flexible member.

In the arrangement where the rigid member provides a passage between the gas and metering chambers, and as illustrated diagrammatically in FIG. 1, gas at a suitable pressure is cyclicly admitted to the gas chamber to open the valve in the passage provided in the rigid member, and thereby permit the gas to enter the metering chamber to displace the fuel therein for delivery to the engine. The fluid forces applied to the rigid member undergo a number of changes during each metering cycle. The principle fluid force phases may be designated as:

1. Fuel circulation through metering chamber.
2. Transition to fuel delivery (fuel valves close fuel pressure rises in metering chamber).
3. Initial fuel displacement (low gas flow rate).
4. Fuel displacement (injection).
5. Transition to fuel circulation (gas blow down).
6. Return to fuel circulation.

The most significant of these six phases from the point of view of fluid forces acting on the rigid member, that performs the fuel metering, are phases 1 and 4. This is partly due to the fact that the transient phases 2, 3 and 5 only exist for a very small period of time compared with phases 1 and 4.

FIG. 1 of the accompanying drawings shows diagrammatically an example of the fuel metering and gas chambers 11 and 36 respectively, the rigid member (metering rod) 12, and inextensible flexible member (wire) 38, arranged as previously described. We shall assume for the purpose of this example the following:

(a) Fuel pressure phase 1=70 kpa
(b) Gas pressure in gas chamber=550 kpa
(c) Crack pressure of valve=100 kpa
(d) Metering rod cross-sectional area A $mm^2$
(e) Wire cross-sectional area a $mm^2$ Note the pressures given are gauge pressures, and forces acting on the metering rod in the direction to increase the quantity of fuel to be delivered will be considered positive.

During phase 1 there is only air at atmospheric pressure in the gas chamber and accordingly the fluid force on the metering rod 12 is that from the fuel pressure in the metering chamber $$F1 = 70 \times A \times 10^{-3} \text{ newtons} = 0.07\,A\,N$$

During phase 4 air is present in the gas chamber at 550 kpa and in the metering chamber at (550−100=450) kpa. The nett fluid force on the metering rod is therefore:

$$F4 = (450\,A - 550\,A + 550\,a)10^{-3} = -0.1\,A + 0.55\,a$$

If $A$ and $a$ are selected so $a = A\ 5.5$

Then $F_4 = 0$ ie. balanced fluid forces on the metering rod.

There are also advantages in reliability of operation to be obtained by selecting the areas 'A' and 'a' so the imbalance force $F_4$ in phase 4 is of the same order as $F_1$ in phase 1. Significant changes in the imbalance fluid force on the metering rod during an injecting cycle will result in "hunting" of the metering rod, and the actuator means will endeavour to compensate for the movemnet of the rod resulting from the changes in the fluid force. Amongst other factors this can increase the wear rate of moving components in the metering apparatus and the associated actuator means.

A generally constant but opposite imbalanced fluid force can be obtained during phases 1 and 4 if $F_1=F_4$ that is in the previous example if $$0.07\,A = -0.1\,A + 0.55\,a$$

$$\text{i.e. } a = \frac{0.17}{0.55}A$$

The fluid forces acting during the transient phases 2, 3 and 5 are difficult to analyse accurately, however as they exist only for a comparatively small portion of the total injection cycle they are considered to be of only minor significance in the design and operation of the fuel metering apparatus.

There are previously proposed constructions of metering apparatus wherein a metered quantity of fuel is prepared in a metering chamber and that metered quantity is delivered from the chamber to the engine by the admission of gas to the chamber at a suitable pressure. Gas is supplied cyclicly to the metering chamber of deliver the fuel to the engine in timed relation to the engine cycle. A pressure operated valve is provided in the port through which the gas is admitted to the chamber.

The prior proposed constructions present operational and manufacturing problems that partly arise from the space restraints inherent in the designs, having regard to the small size of the metering chamber. The problem is more pronounced in metering apparatus for popular size automotive engines, where the metered quantity of fuel is relatively small.

It is therefore a further object of the present invention to provide a method and apparatus for delivering metered quantities of fuel to an engine which is effective in operation, reliable in service and convenient to manufacture.

With this further object in view there is provided apparatus for metering fuel to an internal combustion engine comprising a metering chamber to hold fuel for subsequent delivery to an engine, by the admission of gas to the chamber a rigid member projecting into said chamber and linearly movable relative to the chamber to vary the extent of projection of the rigid member into the chamber to control the quantity of fuel displaceable from the chamber for delivery to an engine by the admission of the gas, and means are provided to circulate fuel through the metering chamber to provide the quantity of fuel to be displaced therefrom, and means are provided to control said fuel circualtion relative to the admission of gas to the metering chamber whereby circulation of the fuel is terminated before admission of the gas to metering chamber.

The invention will be more readily understood from the following description of one practical arrangement of the metering apparatus as illustrated in the accompanying drawings.

Figure 2:
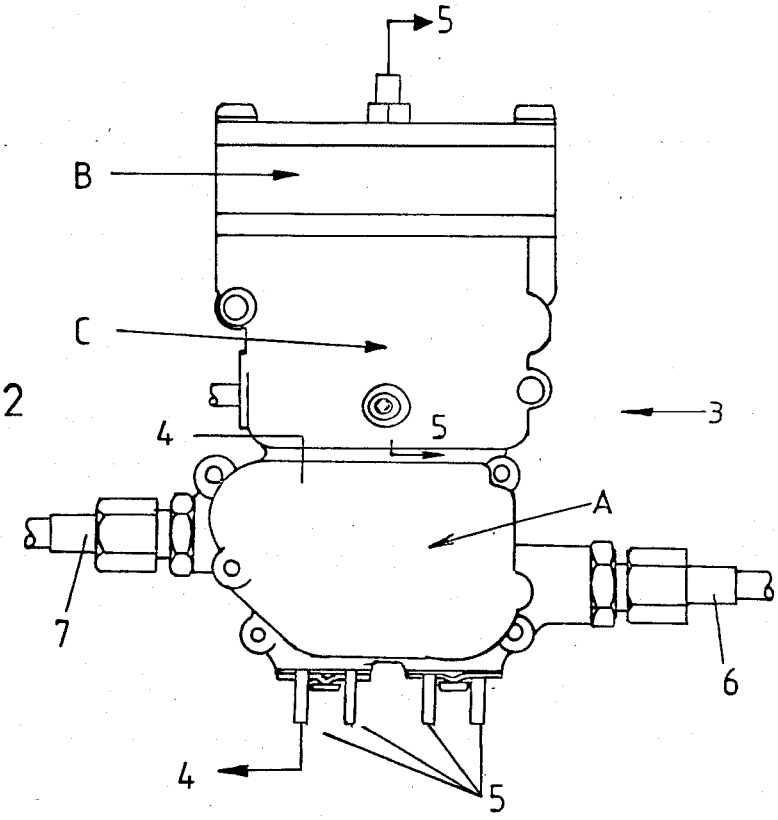
FIG. 2 is a side elevational view of the complete fuel metering unit for a four cylinder engine.
Figure 3:
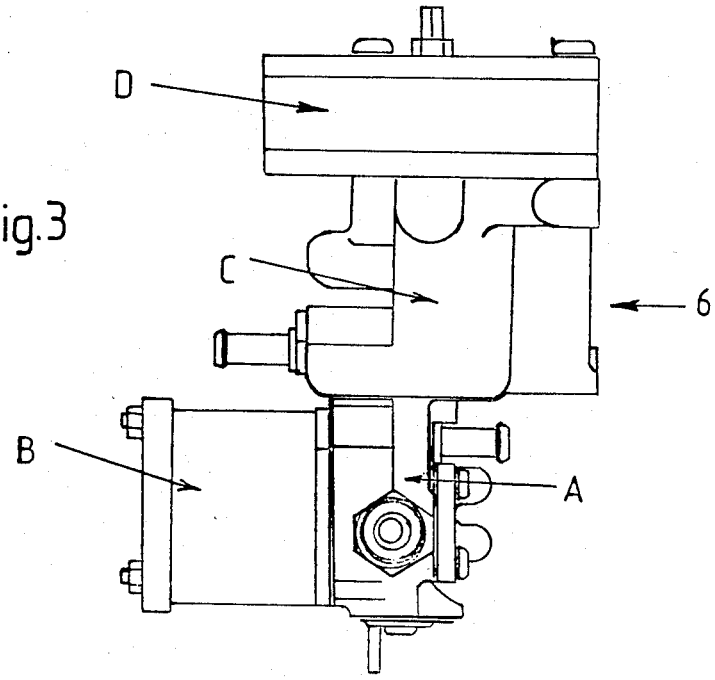
FIG. 3 is a elevational view in the direction of arrow '3' in FIG. 2.
Figure 4:
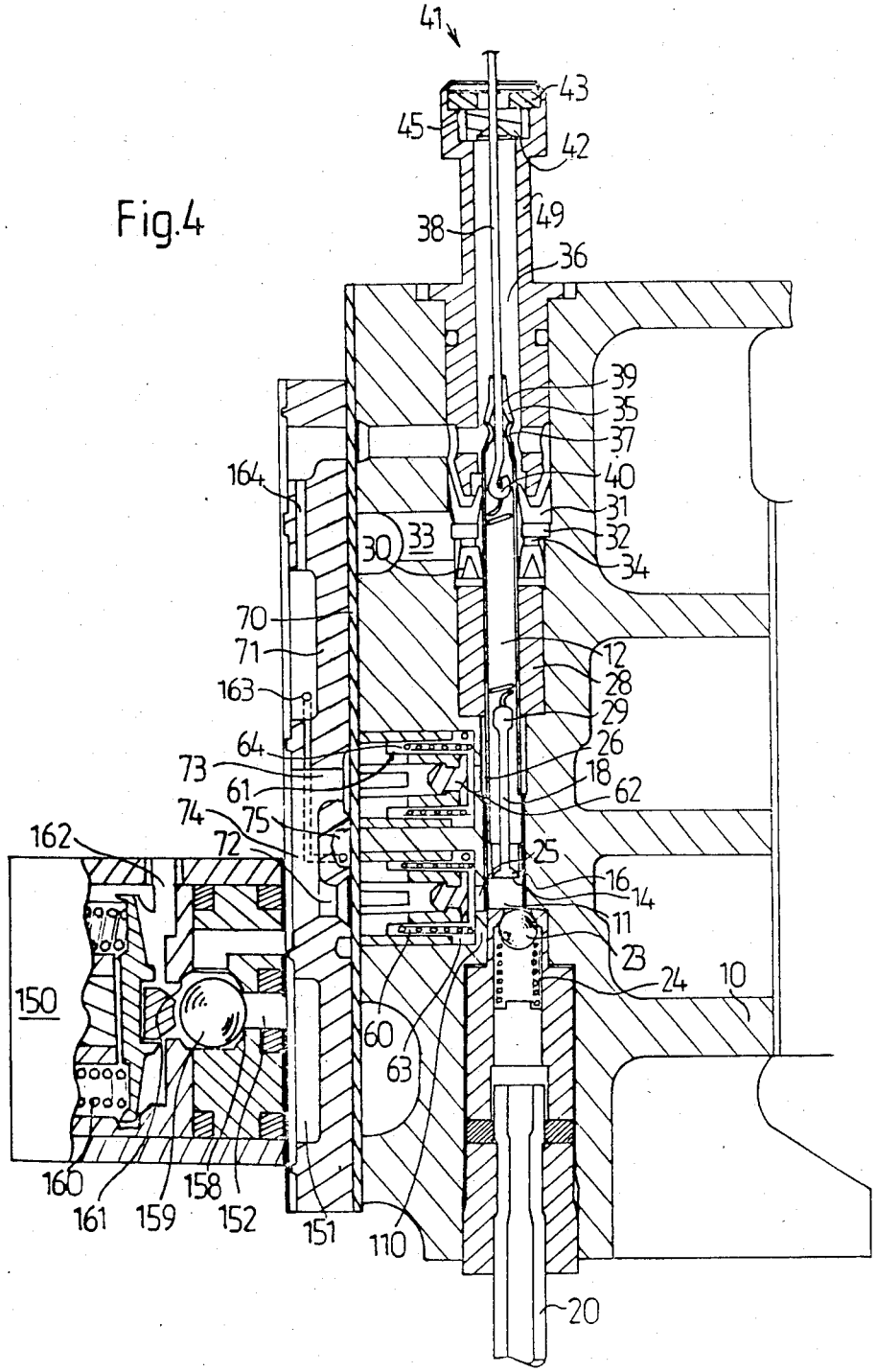
FIG. 4 is a sectional view along line 4—4 in FIG. 2. of the metering section of the unit.

Referring now to FIGS. 2 and 3 the metering unit has a metering chamber portion A incorporating four metering chambers one of which is shown in section in FIG. 4. The fuel from each metering chamber is delivered to an individual cylinder of an engine by tube 5. Fuel is supplied from a fuel tank through the pipe 6 to a common gallery in portion A for each metering chamber. Excess fuel is returned to the fuel tank by the pipe 7 that is also connected to a common gallery in portion A.

The solenoid assembly B incorporates four solenoid actuated valves, one for each metering unit, to control the supply of air to operate fuel valves and the air supply for each metering unit. One solenoid valve unit 150 is shown in detail in FIG. 4.

The actuator portion C of the metering unit incorporates the mechanism whereby the motor D effects control of the quantity of fuel metered to the engine by each metering chamber.

Referring to FIG. 4 of the drawings, the metering apparatus comprises a body 10 having a metering chamber 11 formed therein with a metering rod 12 extending co-axially from one end into the metering chamber and slideably supported in the bush 28 mounted in the body 10. The metering rod 12 is of a tubular form throughout the majority of its length having a port 14 at the lower end normally closed by the valve 16. The valve 16 is connected via the rod 18 to a spring 29 anchored at the opposite end of the metering rod 11 via the hook 40. The construction of the hook 40 and its securement to the metering rod will be described in greater detail hereinafter.

At the end of the metering chamber 11, opposite that through which the metering rod 12 extends, is a fuel delivery port 22 normally closed by a spherical valve 23 biased by the spring 24 into the closed position. Fuel inlet and outlet ports 25 and 26 respectively communicate with the metering chamber 11 at locations spaced along the length thereof.

Respective valves 60 and 61 are provided to control the fuel flow through the ports 25 and 26. Each of the valves includes a seal insert 62 of a suitable slightly resilient material, such as neoprene rubber or like material inert to the fuel. The seal inserts contact the area of the body 10 about the ports 25 and 26 to close the ports when required. The valves 60 and 61 are each biased towards an open position by the springs 63 and 64, and are shown open in FIG. 4. The spring 64 which holds the valve 61 of the fuel outlet port 26 open is of a slightly higher load rating than the spring 63 for reasons that will be discussed later.

The valves 60 and 61 are slidable in respective bores 65 and 66 in the body 10 in which they are located to effect opening and closing of the ports 25 and 26. The valves 60 and 61 at the end thereof opposite the seal inserts 62 each engage the diaphragm 70 held between the body 10 and the air gallery plate 71. The air gallery plate 71 defines with the diaphragm 70 a fuel inlet valve chamber 72 and a fuel outlet valve chamber 73 each communicating with the air supply chamber 74. The chamber 72 has an annular transfer chamber 75 extending there about and is normally separated therefrom by the annular land 76 engaging the diaphragm 70.

It will be noted that the annular land 76 engages the diaphragm 70 within the boundary of the area engaged by the inlet valve 60 on the opposite side of the diaphragm. It will also be noted that the area of the diaphragm exposed to chamber 72 is less than that exposed to chamber 73, each chamber being of circular cross section with chamber 72 of lesser diameter than chamber 73.

This arrangement of the chambers 72 and 73 and the annular transfer chamber 75 and the differing strengths of the springs 63 and 64, is provided to achieve a particular sequence of events when the air supply chamber 74 is coupled to a supply of compressed air. This sequence of events is:

(a) Upon the initial supply of compressed air to the chamber 74, and hence to chamber 72 and 73, the vave 61 will have a larger force applied thereto by the diaphragm than is applied to valve 60. This is due to chamber 73 having a greater area exposed to the diaphragm than chamber 72 and will partly compensate for the spring 64 being stronger than the spring 63.

(b) As soon as the valve 60 commences to move towards the closed position the resulting deflection of the portion of the diaphragm 70 exposed to chamber 72 will break the sealing relationship thereof with the annular land 76, and the air will enter the annular transfer chamber 75.

(c) The transfer chamber 75 provides the communication between the air supply chamber 74 and the hollow interior of the metering rod 12 which effects the opening of the valve 16. Accordingly it will be appreciated that the valve 16 will not open until after both the fuel inlet and outlet ports 25 and 26 have been closed. The air circuit from the transfer chamber 75 to the valve 16 will be described in detail later in this specification.

(d) Upon termination of the supply of compressed air to the chamber 74, and the venting thereof to atmosphere (as hereinafter described) the air pressure in metering rod 12 and the chambers 72 and 73 will fall so that the valve 16, will close and valves 60 and 61 open. However as the spring 64 has a higher load rating than spring 63, the valve 61 will open before valve 60. Accordingly the air present in the metering chamber 11 will be vented through the fuel outlet port 26 in preference to through the fuel inlet port 25. The venting of the air through the fuel outlet port is important as the presence of air in the fuel inlet port, and fuel passages leading thereto, can servely interfere with the subsequent filing of the metering chamber with fuel in preparation for the next fuel delivery cycle.

In the construction shown the metering chamber 11 and the metering rod 12 are each of a circular cross section and are co-axially arranged. When the metering rod is in a low position as shown in FIG. 4, it extends past both the fuel outlet port 26 and substantially across the fuel inlet port 25, and consequently provides a restriction to the flow of the fuel into the chamber from the inlet port 25 and a greater restriction to flow along the chamber towards and through the outlet port 26. Even when the metering rod 12 is positioned with a linear portion thereof extending in the metering chamber 11, there is a significant restriction to the flow of fuel into the fuel outlet port 26. This problem is largely the result of the need to maintain only a small clearance volume between the side wall metering rod 12 and the side wall of the metering chamber 11 so as to achieve the maximum effect in the change of the metered quantity of fuel for a given change in the position of the metering rod. Normally the diametal clearance between the metering rod and the metering chamber wall is of the order of 2 to 3 mm total.

Figure 8C:
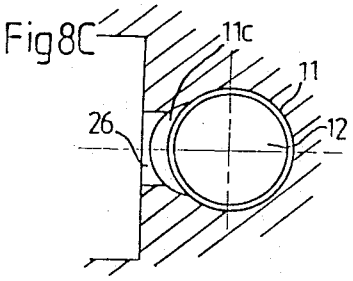
FIGS. 8A, 8B, 8C and 8D are alternative cross sections of the metering chamber at the fuel outlet port.
Figure 8D:
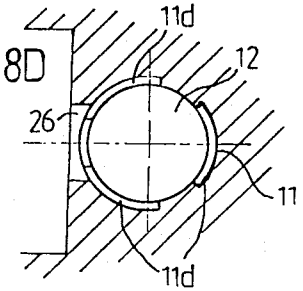
Figure 8B:
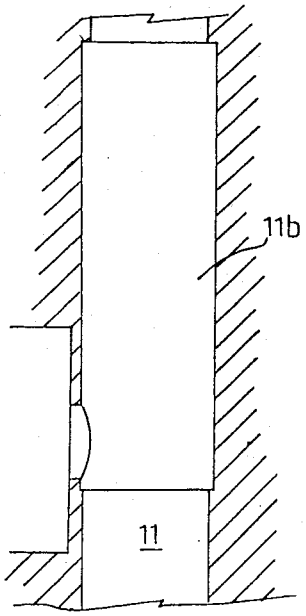
Figure 8A:
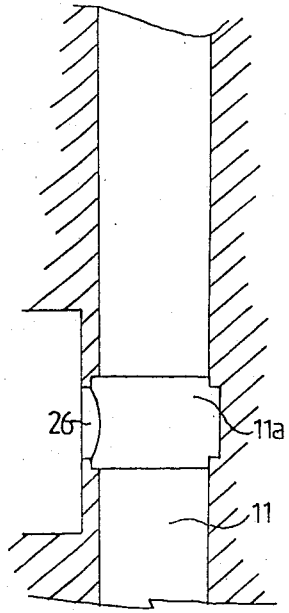
Figure 1:
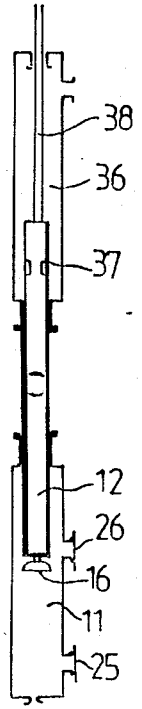
FIG. 1 is a schematic side view of the metering rod, chamber and actuating wire.

In order to reduce this restrictive effect, the metering rod may be positioned eccentrically in the metering chamber so as to provide a greater clearance between the metering rod and the wall of the metering chamber on that side of the chamber in which the fuel inlet and fuel outlet ports are located. Alternatively the diameter of the metering chamber may be increased in the area when the fuel outlet port 26 enters the chamber. The increase in diameter may in the form of a circumferential groove 11A in the chamber wall as shown in FIG. 8A or may extend to the upper end of the chamber as a counter bore 11B as shown in FIG. 8B. The increase in clearance volume above the fuel outlet port is acceptable as it only effects metering accuracy when metering relatively large quantities of fuel, when the clearance volume is a small percentage of the total. Another alternative is to provide a longitudinal groove or grooves in the wall of the metering chamber extending between the fuel inlet and outlet ports. One longitudinal groove 11C is shown in FIG. 8C and three grooves 11D are shown in FIG. 8D. In each of these latter two embodiments a plain circular cross section metering rod is used.

The metering rod 12 is slideably supported in the bush 28 so it may freely slide in the axial direction to vary the position of the gas valve 16 in the metering chamber as required to vary the metered quantity of fuel delivered therefrom. The metering rod also cooperates with a pair of moulded rubber liquid and gas seals 30 and 31 positioned above the bush 28. The seal 30 is positioned to provide a barrier to the passage of fuel or air from the metering chamber 11 in an upward direction along the surface of the metering rod, whilst the seal 31 is positioned to prevent leakage of air downwardly along the surface of the metering rod.

The spacer 32 is located between the opposing seal 30 and 31 and a drain passage 33 communicates with the bore 34 adjacent to the spacer so that any leakage past either of the seals 30 and 31 into this area can be removed from the metering unit, and so prevent the built up of a pressure between the seals. The drain passage 33 may conveniently be connected to the fuel return circuit or to the engine air induction system so that any leaked fuel or fuel vapour is not released to atmosphere.

The upper end portion 35 of the metering rod 12 is located in an air chamber 36 with apertures 37 provided in the metering rod to communicate the air chamber with the hollow interior of the metering rod.

Rigidly secured to the upper end portion 35 of the metering rod is a relatively small diameter rod or wire 38 which extends through the neck portion 39 of the metering rod into the hollow interior thereof. In the neck portion 39 the metering rod 12 and wire 38 are secured together to form a permanent connection. The portion of the wire located within the upper end portion 35 of the metering rod is formed into a hook at 40 to which the upper end of the spring 29 is anchored as previously referred to. The wire 38 extends out of the upper end of the air chamber through a guide and seal assembly 41.

In the practical form of the embodiment illustrated the wire 38 is a stainless steel wire of the order of 0.5 mm diameter with an overall effective length of 50 mm. The slendness ratio of the wire may be up to 300 to 400:1 dependent primarily on the compressed load to be transmitted.

The guide and seal assembly 41 is formed by the cavity 45, in the extension 49 of the bush 17 in which the gas chamber 36 is formed, and the floating seal 42 and retainer ring 43. The floating seal 42 is restrained against movement in the longitudinal direction of the wire 38 by the retainer 43 and the base of the cavity 45, and has a limited freedom of movement in the transverse direction as a result of the diametral clearance between the seal 42 and the peripheral wall of the cavity 45. This lateral movement permits the seal to adjust its position to accommodate any minor misalignment between the wire 38 and the metering rod 12 or the wire clamp assembly 55 shown in FIG. 5. The wire 38 extends through a central aperture in the floating seal and is a close sliding fit therein to restrict leakage therethrough. When the gas chamber 36 is pressurised the seal 42 is pressed hard against the retainer 43 so preventing gas leakage between their faces.

Figure 5:
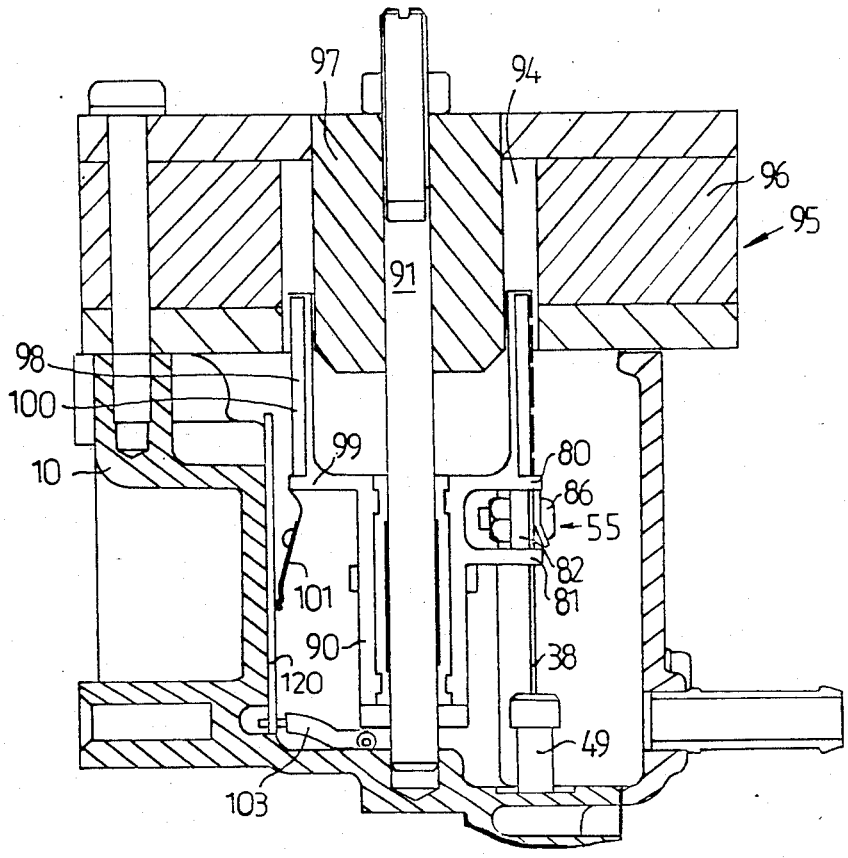
FIG. 5 is a sectional view along line 5—5 in FIG. 3.
Figure 6:
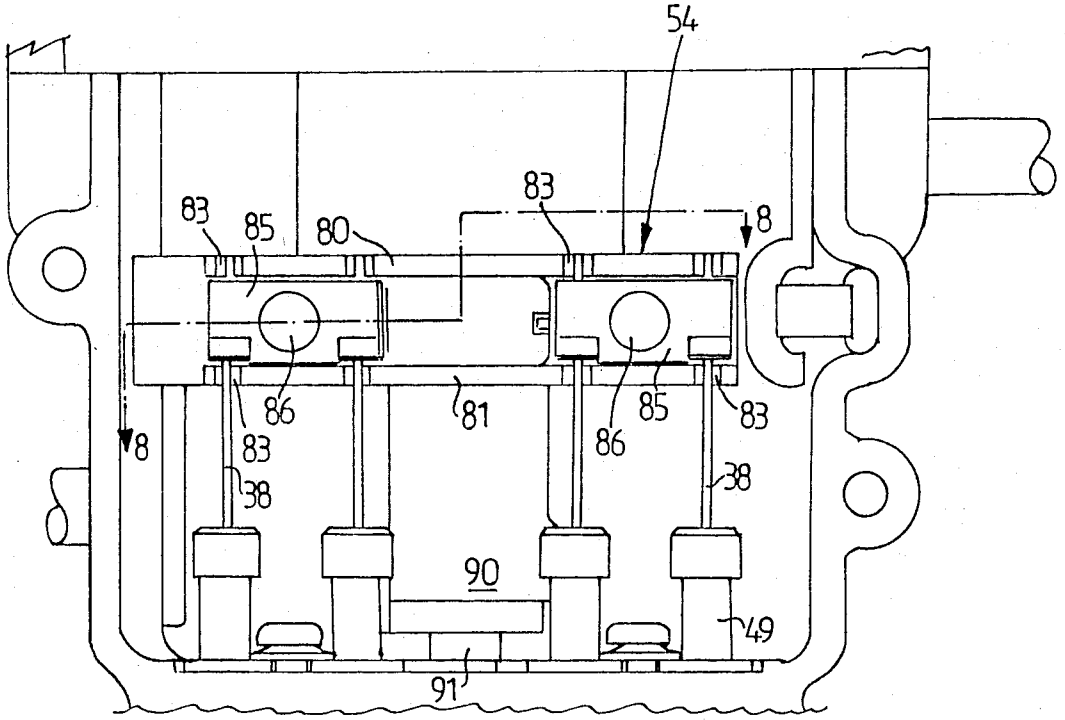
FIG. 6 is viewed in the direction of arrow '6' in FIG. 2 and the cover plate removed.
Figure 7:
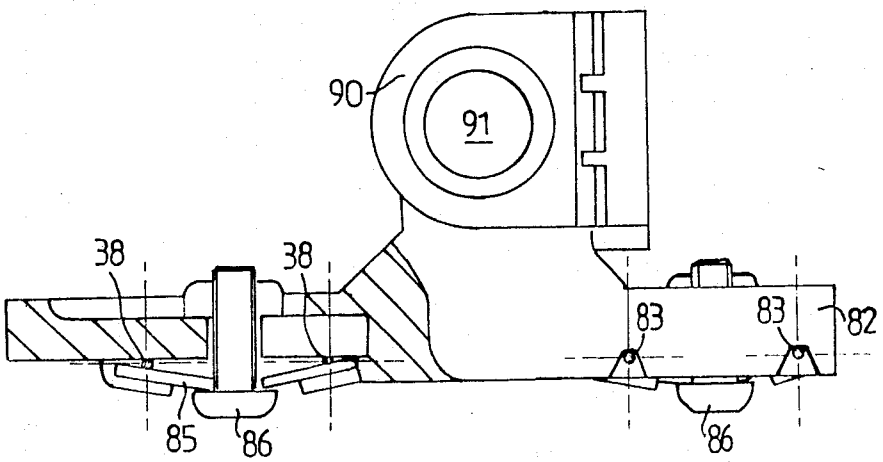
FIG. 7 is a fragmental sectional view along line 7—7 in FIG. 6.

As further shown in FIGS. 5, 6 and 7 the clamp assembly 55 is part of a common beam 54 to which the wires 38 from the four metering units are coupled, so that the control of the metering rods in the respective units can be effected simultaneously. The beam 54 is coupled to an appropriate actuator device as will be described in further detail later.

The beam 54 is of channel shape having top and bottom flanges 80 and 81 and a web 82. Each of the flanges has respective notches 83 so that each wire 38 is located within aligned notches in the top and bottom flanges. The notches 83 are of a depth such that when the wire is located in the base thereof the wire lies in contact with the face of the web 82 of the beam. Two clamp plate 85 are provided to be positioned between the flanges 80 and 81 and to each press two wires 38 against the face of the web 82 so that they are gripped therebetween.

In the embodiment shown each clamp plate 85 has a central clamping bolt 86 so that each end of the plate clamps a respective wire 38. In a free state the double ended clamp plate is of a shallow V formation and is deflected into a substantially flat form when the central clamp bolt 86 is fully tightened. This form of clamp plate enables a relatively light clamping force to be obtained by partially tightening the clamping bolt 86, whilst full clamp force is obtained when the bolt is fully tightened to substantially flatten the clamp plate. FIG. 7 of the drawings shows clamp plate 85 lightly clamping wires 38. This construction enables the wires to be initially lightly clamped to the beam 54 whilst the position of the metering rods 12 within the respective metering chambers 11 are initially set. It is to be understood that all of the metering rods connected to the one beam must be individually set so that the minimum fuel delivery from each of the metering chambers that the rods operate in is the same. Thereafter each of the clamp bolts may be fully tightened and the metering rods will be retained in their set position to give uniformity of metering from all metering chambers.

The beam 54 is formed integral with the armature guide sleeve 90 which is slidably mounted on the fixed rod 91. The solenoid type motor 95 located in the upper part of the body 10 comprises an annular permanent magnet 96 co-axial with the rod 91 and a core 97. An annular gap 94 is formed between the magnet 96 and the core 97 into which the armature 98 extends. The armature guide sleeve 90 in integral with the carrier 99 on which the armature coil 100 is mounted.

The sliding contact arm 101 is connected to the coil 100 and travels along the contact strip 102 as the armature 98 moves in either direction along the rod 91. The contact strip 102 is connected by the conductor 103 to a controlled electric current source which is varied in response to the engine fuel demand. The armature 98 will take up a position in the annular gap 94 determined by the relative strengths of the magnetic field generated by the current flowing in the coil 100, and the magnetic field created by the permanent magnet 96 and thus control the position of the metering rods 12 in the metering chambers 11. The electric current supplied to the armature 98 is controlled by an electronic processor that receives inputs related to the engine fuel demand and varies the current input to the armature coil 100 to locate the metering rods at the required position in the metering chamber so the required fuel quantity is delivered to the engine.

The delivery of fuel from the metering chamber 11 to the engine is effected by admitting air to the metering chamber from the gas chamber 36 and the opening of the fuel delivery port 22. The pressure of the air supplied to the gas chamber 36 is sufficient to open the valve 16, normally held closed by the spring 29, and open the delivery valve 23, normally held closed by the spring 24. In addition the air pressure is sufficient to displace the fuel in the metering chamber between the ports 14 and 22, and convey it to the point of delivery to the engine through the fuel conduit 20. The above principle of discharging a metered quantity of fuel from a metering chamber by a pulse of air, and varying the metered quantity by adjusting the position of entry of the air to the chamber is discussed in detail in U.S. Pat. No. 4,462,760 and No. 4,554,945.

It will be noted in FIG. 4 that the centreline of the fuel delivery port 22 is offset from the centreline of the metering chamber 11 in the direction away from the fuel inlet port 25. This offset arrangement enables the inlet port 25 to have its lower extremity at the level of or slightly below the bottom of the metering chamber 11 and also provide a sufficient portion 110 of the body 10 to support the seat of the valve 23. The locating of the fuel inlet port at or below the bottom of the metering chamber enables the metering rod 12 to be positioned lower in the chamber when at the minimum metered fuel quantity position. This is important when metering fuel for a small capacity engine with a very small fuel demand at low lead.

The control of the admission of air to the air supply chamber 74, is regulated in time relation with the cycling of the engine by the solenoid operated valve 150. The common air supply conduit 151 connected to a compressed air supply not shown, extends through the air gallery plate 71 with respective branches 152 providing air to the respective solenoid valve 150 of each metering unit.

Normally the spherical valve element 159 is seated in the port 158 by the springs 160 to prevent the flow of air from conduit 151 to the chamber 74, and to vent the chamber 74 to atmosphere via vent port 161 and passage 162. When the solenoid is energised the force of the springs 160 is released from the valve element 159, and it is displaced by the pressure of the air supply to open the port 158 and permit air to flow from conduit 151 to the chamber 74 and to close the port 161. The admission of the air to the chamber 74 effects closure of the fuel inlet and outlet ports as previously described. After the diaphragm 70 has been deflected sufficiently to permit the air to enter the annular transfer chamber 75 air will then pass via the ducts 163 and 164 to the gas chamber 36. The air then passes through the opening 37 into the hollow metering rod 12 and effect opening of the valve 16 so air enters the metering chamber through the port 14.

As previously referred to there is a small time delay between the closing of the fuel inlet and outlet ports 25 and the air passing to the metering rod to open the gas port 14. This delay ensures that the air is not admitted to the metering chamber before the fuel inlet and outlet ports are closed. Premature admission of air to the metering chamber would result in some of the metered quantity of fuel in the metering chamber being discharged through the fuel outlet port 26 and passing also through fuel inlet port 26 thus reducing the quantity of fuel available for delivery to the engine through the delivery port 22.

After air has been supplied to the metering chamber 12 for a period sufficient to displace the metered quantity of fuel therefrom and deliver the fuel to the engine the solenoid is de-energised and the valve element 159 again closes the port 158 to terminate the supply of compressed air to the air supply chamber 74. As a result of the closing of port 158 the port 161 is opened so that the chamber 74 is vented to atmosphere via passage 162 as previously described, the gas port 14 is closed and the fuel inlet and outlet ports 25 and 26 opened so that the metering chamber 12 is filled with fuel preparatory to the next fuel delivery.

The claims defining the invention are as follows:

1. Apparatus for metering fuel for delivery to an engine comprising a chamber elongated in one direction and having opposite end walls, a metering member projecting into the chamber through one end wall and a fuel discharge port in the other end wall and that end of the metering member within the chamber being moveable to thereby vary the quantity of fuel receivable in the chamber and displacable therefrom through the discharge port, and a fuel inlet port in a side wall of said chamber extending between the end walls of the chamber, said fuel inlet port being located adjacent the junction of said side wall and the other end wall and the discharge port being located offset from the centre of the other end wall in a direction away from the fuel inlet port.

2. Apparatus as claimed in claim 1, wherein the fuel inlet port extends to the junction of the side wall and the other end wall of the chamber.

3. Apparatus as claimed in claim 1, wherein a fuel outlet port is provided in the side wall of the chamber spaced from said fuel inlet port in the direction towards the one end wall of the chamber, clearance being provided between the chamber and the metering member and the cross-sectional area of that clearance being increased over at least a part of the length of the chamber, that increased clearance area communicating with the fuel outlet port.

4. Apparatus as claimed in claim 3, wherein at least one longitudinal groove is provided in said side wall of the chamber to provide said increased cross-sectional area.

5. Apparatus as claimed in claim 1 or claim 2, wherein said fuel outlet port is provided in the side wall of the chamber spaced from said fuel inlet port in the direction towards the one end wall of the chamber, and at least one longitudinal groove is provided in the external surface of the metering member on that side of the metering member directed toward the fuel outlet port and extending from that end of the metering member located in the chamber.

6. Apparatus as claimed in claim 1 or 2, wherein said fuel outlet port is provided in the side wall of the chamber spaced from said fuel inlet port in the direction towards the one end wall of the chamber, the external surface of the metering member being shaped such that the clearance between the portion of the chamber wall in which the fuel outlet port is located and the surface of the metering member opposite thereto is greater than the clearance between the metering member and the wall of the chamber opposite the fuel outlet port.

7. Apparatus as claimed in claim 1 or 2, wherein said fuel outlet port is provided in the side wall of the chamber spaced from said fuel inlet port in the direction towards the one end wall of the chamber, the metering member being of substantially circular cross-section, and the axis of the metering member is offset with respect to the axis of the chamber in a direction away from the fuel outlet port.

8. Apparatus for metering fuel for delivery to an engine comprising a chamber elongated in one direction, fuel inlet and outlet ports in said chamber spaced in the direction of elongation, a metering member projecting into the chamber through one end wall of the chamber and a fuel discharge port in the other end wall of the chamber, means to selectively admit gas to said metering chamber to displace the fuel therefrom through the discharge port, means to linearly move the metering member relative to the chamber in the direction of elongation to control the extent of projection of the metering member into the chamber to thereby vary the quantity of fuel receivable in the chamber and displacable therefrom through the discharge port, the cross-sectional area of that clearance between the chamber and the metering member being increased over at least part of the length of the chamber, that increased cross-sectional area communicating with the fuel outlet port.

9. Apparatus for metering fuel for delivery to an engine comprising a chamber elongated in one direction and having opposite end walls, a metering member projecting into the chamber through one end wall of the chamber and a fuel discharge port in the other end wall, means to selectively admit gas to said metering chamber to displace the fuel therefrom through the discharge port, means to linearly move the metering member relative to the chamber to control the distance between said other end wall of the chamber and that end of the metering member within the chamber to thereby vary the quantity of fuel receivable in the chamber and displacable therefrom through the discharge port, and a fuel inlet port and a fuel outlet port in a side wall of said chamber extending between the end walls of the chamber, said fuel inlet port being located adjacent the junction of said side wall and the other end wall of the chamber and the fuel outlet port being spaced from the fuel inlet port in a direction towards the one end wall of the chamber, the cross-sectional area of that clearance between the chamber and the metering member being increased over at least a part of the length of the chamber, that increased cross-sectional area communicating with the fuel outlet port.

10. Apparatus as claimed in claim 8 or 9, wherein at least one longitudinal groove is provided in said side wall of the chamber to provide said increased cross-sectional area.

11. Apparatus as claimed in claim 8 or 9, wherein at least one longitudinal groove is provided in the external surface of the metering member on that side of the metering member directed towards the fuel outlet port, said groove extending from said end of the metering member located in the chamber.

12. Apparatus as claimed in claim 8 or 9, wherein the external surface of the metering member is shaped such that the clearance between the portion of the chamber wall in which the fuel outlet port is located and the surface of the metering member opposite threto is greater than the clearance between the metering member and the wall of the chamber opposite the fuel inlet port.

13. Apparatus as claimed in claim 8 or 9, wherein the metering member is of substantially circular cross-section, and the axis of the metering member is offset with respect to the axis of the chamber in a direction away from the fuel outlet port.

* * * * *

UNITED STATES PATENT AND TRADEMARK OFFICE

CERTIFICATE OF CORRECTION

PATENT NO. : 4,803,968

DATED : February 14, 1989

INVENTOR(S) : SAYER et al

It is certified that error appears in the above-identified patent and that said Letters Patent is hereby corrected as shown below:

On the cover page, above Item [54], "Czwienczek et al" should read --Sayer et al--;

Item [75] "Peter W. Czwienczek, Padbury; Christopher N. F. Sayer, Ferndale; Darren A. Smith, Scarborough; Michael L. McKay, Willetton; Robin M. Briggs, Marmion, all of Australia" should read --Christopher N. F. Sayer, Ferndale; Robin M. Briggs, Marmion, both of Australia--.

Signed and Sealed this

Sixth Day of February, 1990

*Attest:*

JEFFREY M. SAMUELS

*Attesting Officer*

*Acting Commissioner of Patents and Trademarks*